US006447089B1

(12) United States Patent
Arquilevich et al.

(10) Patent No.: US 6,447,089 B1
(45) Date of Patent: Sep. 10, 2002

(54) TECHNIQUES FOR USING A LINEAR ARRAY TO DETECT MEDIA TOP/BOTTOM EDGES FOR FULL BLEED PRINTING

(75) Inventors: Dan Arquilevich; Steven B. Elgee, both of Portland, OR (US); Rick M. Tanaka; Sam M. Sarmast, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/688,012

(22) Filed: Oct. 13, 2000

(51) Int. Cl.[7] ..... B41J 2/01
(52) U.S. Cl. ..... 347/16
(58) Field of Search ..... 347/16, 19, 104; 400/708; 271/227

(56) References Cited

U.S. PATENT DOCUMENTS 4,647,239 A 3/1987 Maezawa et al. ..... 400/708
5,732,943 A * 3/1998 Delfosse ..... 271/228
6,106,115 A * 8/2000 Mueller et al. ..... 347/104

FOREIGN PATENT DOCUMENTS

| | | |
|---|---|---|
| JP | 04018379 | 1/1992 |
| JP | 05069608 | 3/1993 |
| JP | 11170639 | 6/1999 |

OTHER PUBLICATIONS

European Search Report, Dec. 18, 2001.

* cited by examiner

*Primary Examiner*—Craig A. Hallachel
(74) *Attorney, Agent, or Firm*—Manuel Quiogue

(57) ABSTRACT

Printing apparatus that employs a media detect switch and a linear optical detector to accurately detect the leading edge or trailing edge of a print medium to modify print data so that printing does not extend off the print medium beyond the leading edge or trailing edge. Also disclosed are techniques for using the media detect switch to control a media advance operation to position the leading edge or trailing edge of the print medium in the field of view of the linear array optical detector.

34 Claims, 6 Drawing Sheets

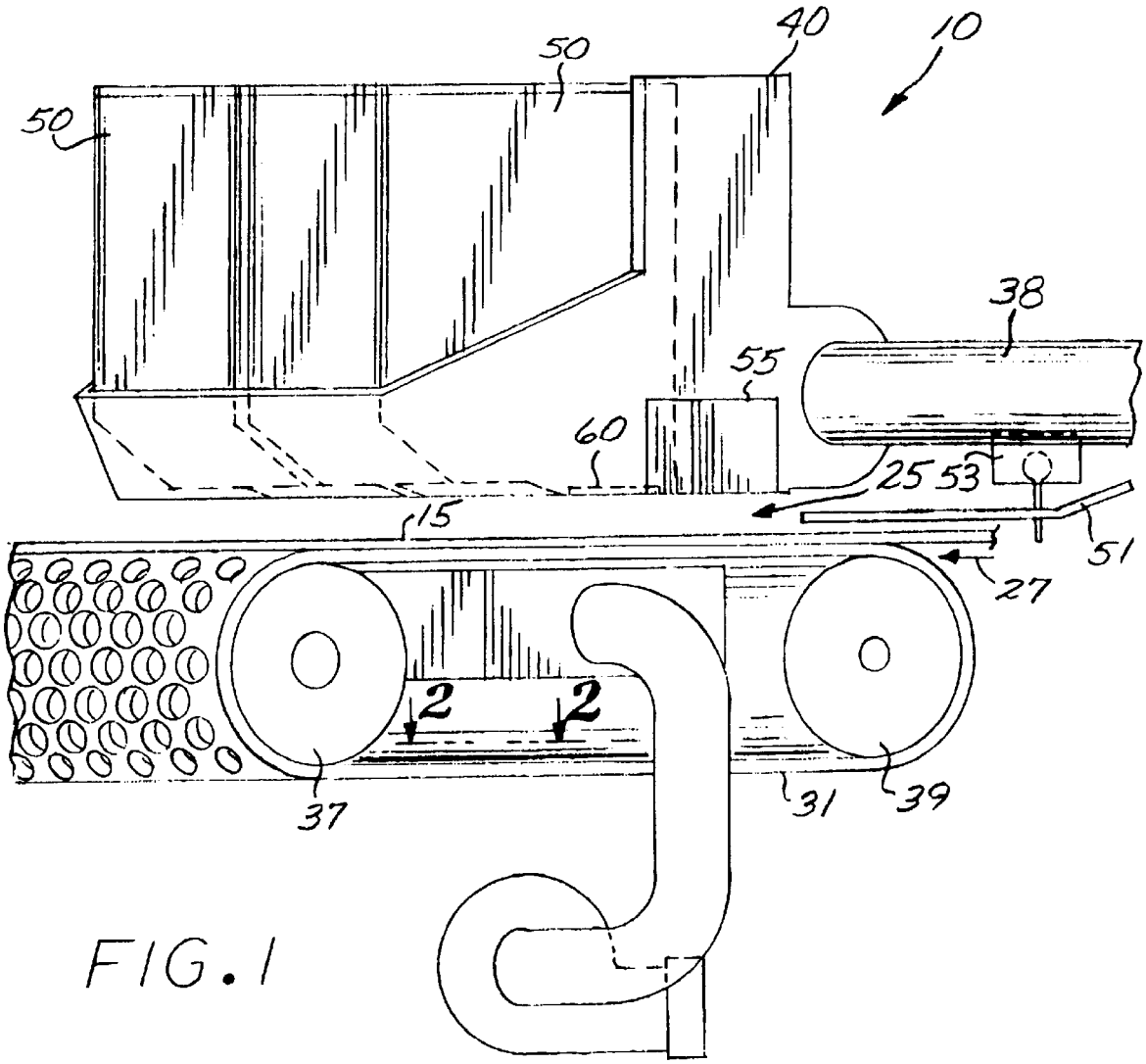
FIG. 1
FIG. 2
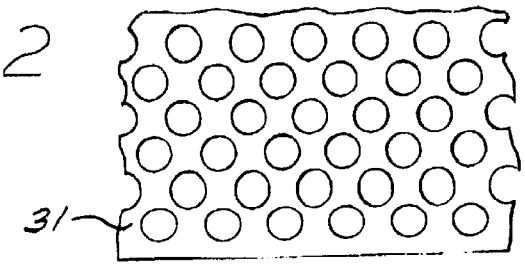

TECHNIQUES FOR USING A LINEAR ARRAY TO DETECT MEDIA TOP/BOTTOM EDGES FOR FULL BLEED PRINTING

BACKGROUND OF THE INVENTION

The disclosed invention is generally directed to ink jet printing, and more particularly to techniques for accurately detecting the top edge and/or bottom edge of print media for full bleed printing.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

It has become desirable to provide "edge to edge" or "full bleed printing" wherein the printed image extends to the edges of the print media, for example for photographic images.

A consideration with full bleed printing is the need to accurately determine the location of the leading and trailing edges (also referred to as top and bottom edges) of the print medium to avoid depositing excessive amounts of ink off the leading edge and trailing edge of the print media onto the media handling mechanism of the printer. Such off-media ink deposition causes unwanted marking of the back side of print media subsequently printed, which is deleterious to double sided printing. Also, the off-media deposition of ink could cause the media advance mechanism to malfunction.

SUMMARY OF THE INVENTION

The disclosed invention is directed to a printing apparatus that employs a media detect switch and a linear array optical detector to position an edge of a print medium that is generally transverse to the media axis in the field of view of the linear array which can have a field of view along the media axis that is less than the incremental media advances employed by the printing apparatus. In accordance with further aspects of the invention, such transversely extending edge of the print medium is scanned with the linear array to detect the location of the edge along the media axis, and printing is controlled so as to avoid printing off the print medium beyond the detected edge.

BRIEF DESCRIPTION OF THE DRAWINGS

The advantages and features of the disclosed invention will readily be appreciated by persons skilled in the art from the following detailed description when read in conjunction with the drawing wherein:

FIG. 1 is a schematic depiction of an ink jet printing device in which the disclosed invention can be employed.

FIG. 2 is a plan view illustrating a portion of the media supporting endless belt of the ink jet printing system of FIG. 1.

DETAILED DESCRIPTION OF THE DISCLOSURE

Figure 3:
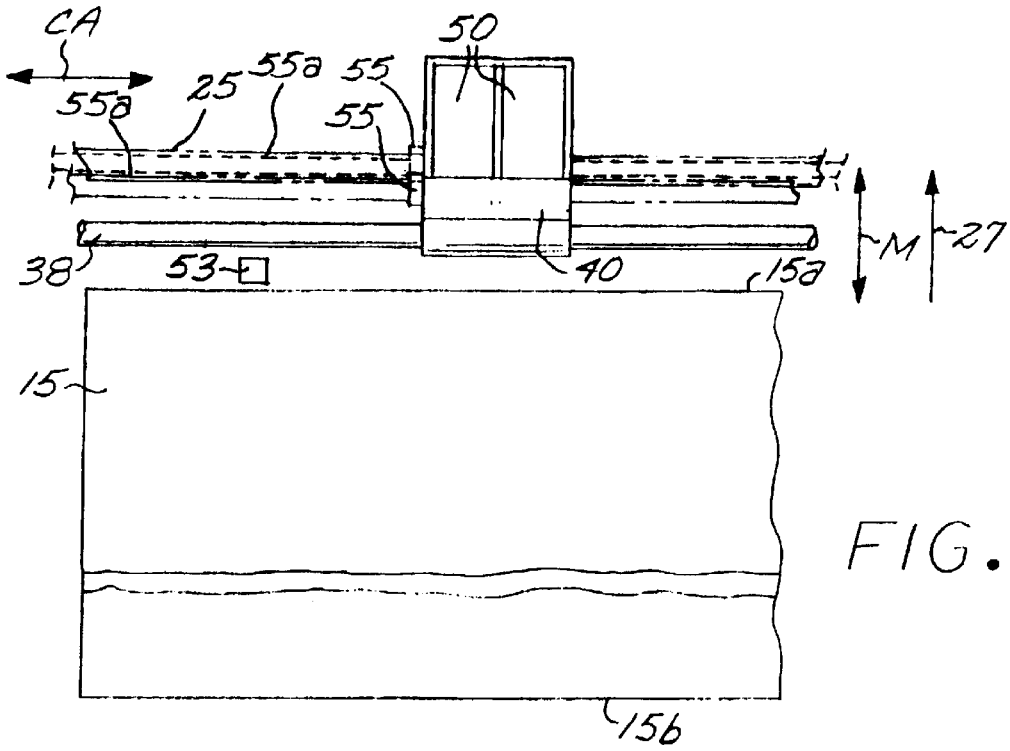
FIG. 3 is a schematic plan view illustrating the relative locations of media edge detecting components of the ink jet printing device of FIG. 1.

In the following detailed description and in the several figures of the drawing, like elements are identified with like reference numerals.

FIG. 1 is a schematic depiction of an examplary ink jet printing device 10 in which the disclosed invention can be employed. The ink jet printing device includes one or more ink jet print cartridges 50 that are supported by a print carriage 40 mounted on a slider rod 38 for reciprocating scanning movement along a carriage axis CA (FIG. 3). Each of the ink jet print cartridges 50 includes an ink jet printhead 60 having a plurality of ink drop generators for depositing ink jet dots on a portion of a print medium 15 (e.g., paper) that is located in a print zone 25 that underlies the area or region swept by the ink drop generators as the print carriage 40 is scanned. By way of illustrative example, each ink drop generator is a thermal ink jet drop generator comprised of a heater resistor, an ink chamber, and a nozzle.

The print medium 15 is more particularly supported and advanced along a media axis MA in a media advance direction 27 through the print zone 25 by an endless belt media transport subsystem that includes an endless perforated belt 31 (also shown in FIG. 2) mounted for rotation on belt pulleys 37, 39 that are driven to advance the print medium 15. The print medium 15 is picked from an input supply (not shown) and its leading edge 15*a* (FIG. 3) is delivered to a guide 51 that is configured to deliver the leading edge of the print medium 15 to the endless belt 31. An optional pinch roller may be used to assist transport of the print medium 15 through the print zone along a media axis MA. A vacuum plenum 41 that is coupled to a vacuum inducing pump 43 holds the print medium 15 tightly against the belt surface at the print zone. An output roller may be optionally used to receive the leading edge of the print medium 15 and continue the transport of the print medium until the trailing edge 15*b* (FIG. 3) of the print medium is released.

Figure 4:
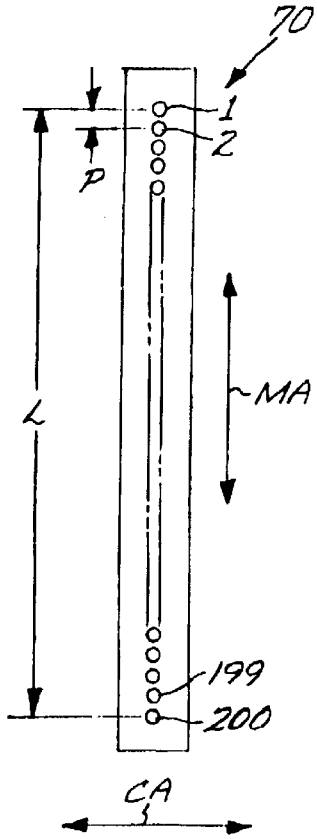
FIG. 4 is a schematic depiction of an ink jet nozzle array of the printer of FIG. 1.

As illustrated in FIG. 4, each of the printheads 60 of the print cartridges 50 of the printer of FIG. 1 includes an array 70 of ink jet nozzles having a center to center spacing or pitch P along the media axis MA, and a nozzle array height or length L along the media axis MA. For illustration purposes, the nozzle array 60 is shown as having 200 nozzles that are sequentially numbered in such a manner that nozzle 200 first encounters the print medium 15 as it is advanced along the media axis MA.

Figure 5:
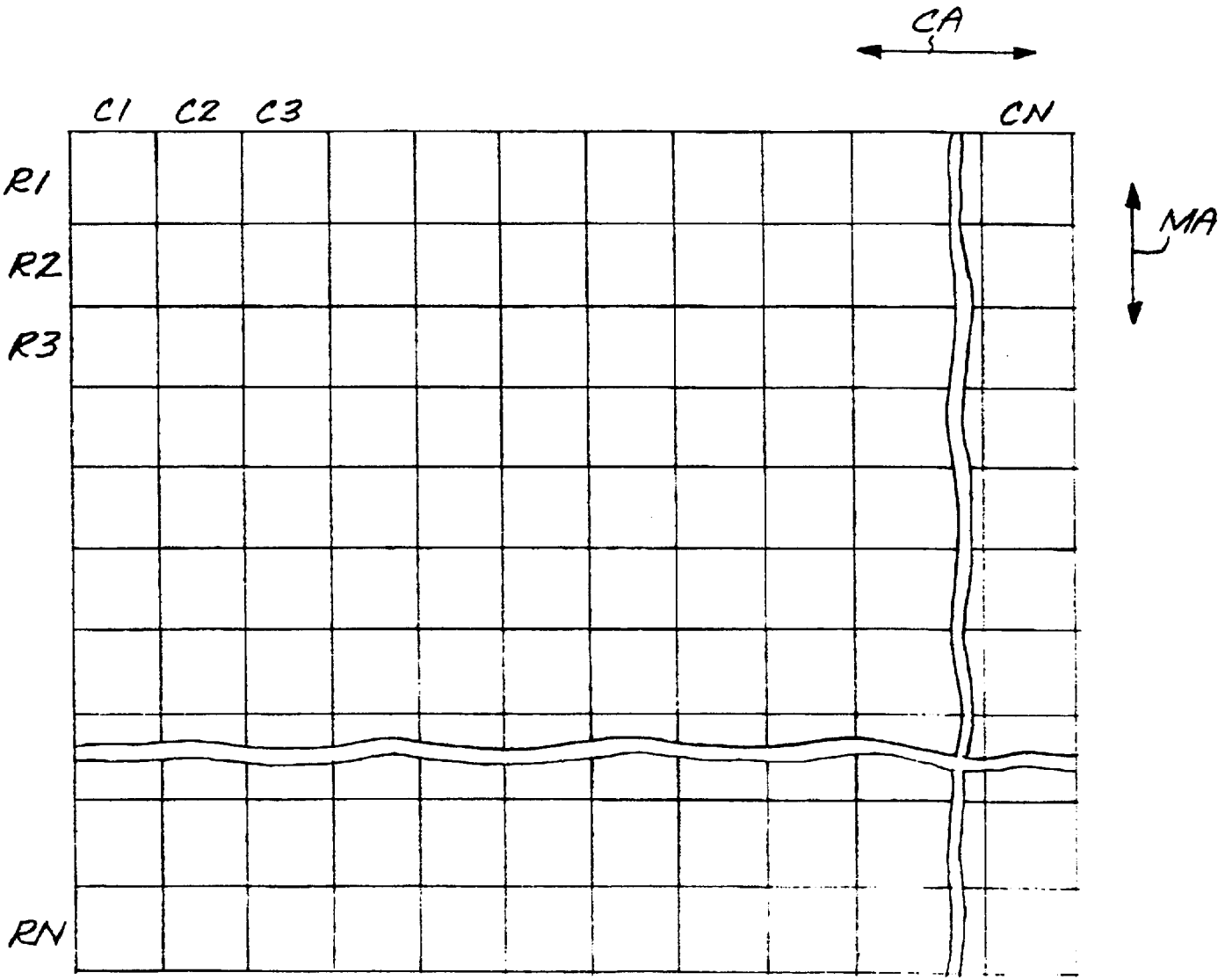
FIG. 5 schematically depicts a pixel array that would be printed by the ink jet printing device of FIG. 1.

Printing is accomplished by incrementally advancing the print medium 15 through the print zone 25, and controlling the ink jet nozzles to deposit ink drops while the carriage 40 is scanned between media advances. Referring more particularly to FIG. 5, the printer forms an image by scanning the print carriage 40 along the carriage axis and printing dots at selected pixel locations P of a two-dimensional pixel array defined for the image to be printed. The pixel locations or pixels P are conveniently arranged in rows R1 through RN and columns C1 through CN, wherein the rows are aligned with the carriage scan axis CA and the columns are aligned with the media axis MA. The number of pixels per unit distance along the carriage scan axis is referred to as the carriage axis resolution, while the number of pixels per unit distance along the media axis is referred to as the media axis resolution. The center to center distance between adjacent columns is the carriage axis dot pitch, while the center to center distance between adjacent rows is the media axis dot pitch.

It should be appreciated that an image is formed of a pattern of dots deposited on the pixel array, and the pixel locations that receive dots are sometimes referred to as pixels that are "on". Also, it is sometimes convenient to refer to the pixel rows of the image that is being printed, wherein each pixel row contains an appropriate pattern of pixels for that image.

Referring also to FIG. 3, the ink jet printing system further includes a linear array optical detector 55 mounted on the print carriage 40 and located upstream of the print zone 25 so that the leading edge of the print medium 15 first enters a field of view 55*a* of the linear array 55 prior to entering the print zone 25. The linear array 55 is aligned with the media axis MA so that its field of view 55*a* has an extent along the media axis, which allows detection of the position or location along the media axis of the leading edge or trailing edge that extend generally transverse or laterally to the media axis. The linear array more particularly is scanned along the carriage axis by scanning the print carriage 40 to detect the position of the leading or trailing edge along the media axis at a plurality of sample locations along the edge. Such edge position samples are then be utilized to produce an edge profile or contour. By way of illustrative example, the field of view 55*a* of the linear array 55 partially or fully overlaps the print zone 25 which would allow for calibration of the position of the linear array relative to the print zone. Where the field of view 55*a* fully overlaps the print zone 25, the field of view can be contained completely in the print zone 25 as schematically depicted in FIG. 3 by broken line versions of the linear array 55 and the field of view 55*a*.

A media detect switch 53 is located upstream of the linear array 55 so that the leading or trailing edge of the print medium is detected by the media detect switch 53 prior to entering the field of view of the linear array 55. The media detect switch comprises for example an opto-mechanical switch having a switch lever or mechanical flag that extends through a slot in the guide 51 into the paper path and is actuated by the print medium 15. By way of specific example, the media detect switch comprises an out of paper sensor that is conventionally employed in printers. A transition in the output of the media detect switch indicates that the leading or trailing edge is at the media detect switch at the time of transition. In accordance with an aspect of the invention, the leading edge 15*a* of the print medium 15 is detected by the media detect switch 53 and the print medium 15 is appropriately advanced to stationarily position the leading edge within the field of view of the linear array 55 so that the leading edge can be optically scanned. For example, since the position of the media detect switch relative to the linear array is known, a coarse position of the leading edge is detected by the media detect switch as the print medium 15 is being advanced, and the advance of the print medium is continued by an appropriate amount to position the leading edge in the field of view 55*a* of the linear array 55. Once the leading edge is positioned in the field of view 55*a* of the linear array 55, the leading edge is optically scanned with the linear array 55 detect a fine position or location of the leading edge along the media axis.

In accordance with another aspect of the invention, the coarse position of the trailing edge 15*b* is detected by the media detect switch 53, and a determination is made as to whether the trailing edge will eventually land within the field of view 55*b* of the linear array 55, based on the nominal media advance for the print mode in use. If the trailing edge will not land within the field of view of the linear array 55, the media advance operation being employed is changed to modify the media advance increments so that the trailing edge will land within the field of view of the linear array 55. Once the trailing edge is positioned within the field of view of the linear array 55, the trailing edge is optically scanned with the linear array 55 to detect a fine position or location of the trailing edge along the media axis.

More generally, the media detect switch 53 and the linear array 55 are employed to position in the field of view of the linear array an edge of the print medium that is generally transverse to the media axis MA, so that a fine position or location of such edge can be determined by scanning the linear array along such edge.

Figure 6:
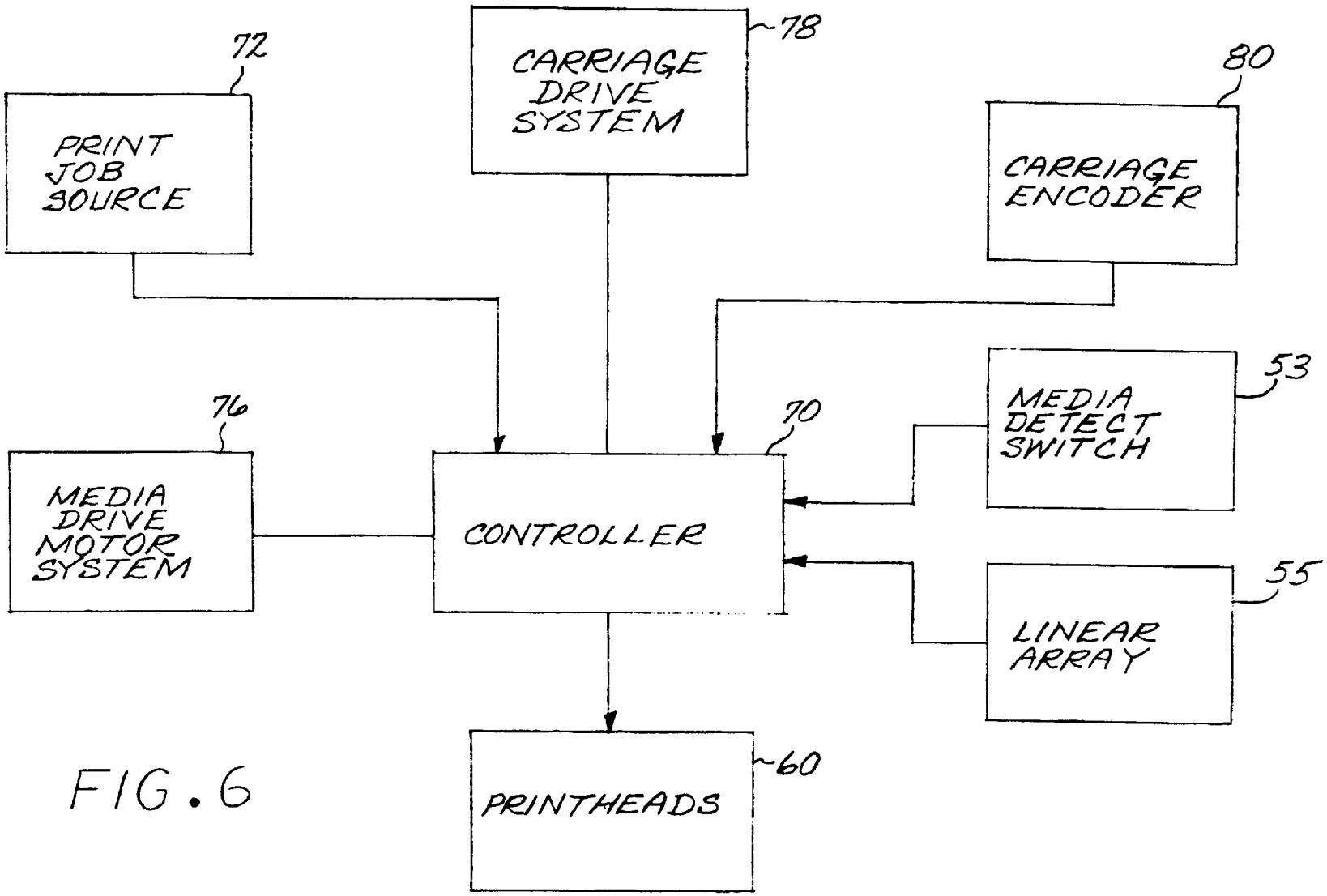
FIG. 6 is a block diagram of a control system for the printing device of FIG. 1.

FIG. 6 is a schematic block diagram of a control system for the printer of FIG. 1. A controller 70 such as a microcomputer receives print job commands and data from a print job source 72, which can be a personal computer, digital camera or other source of print jobs. The controller 70 acts on the received commands and data to activate a media drive motor system 76 to advance the print medium onto the belt, and move the belt to advance the sheet through the print zone 25. A carriage drive system 78 is controlled by the controller 70 to scan the carriage 40 along the slider rod 38. As the carriage 40 moves, firing signals are sent to printheads 60 of the print cartridges 50. The controller receives encoder signals from a carriage position encoder 80 to provide position data for the print carriage 40. The controller 70 is programmed to incrementally advance the print medium 15 to position the print medium for successive scans of the print carriage 40 across the print medium 15.

The controller further receives outputs of the media detect switch 53 and the optical linear array 55, and performs printing operations based on such outputs as more particularly described herein.

Figure 7:
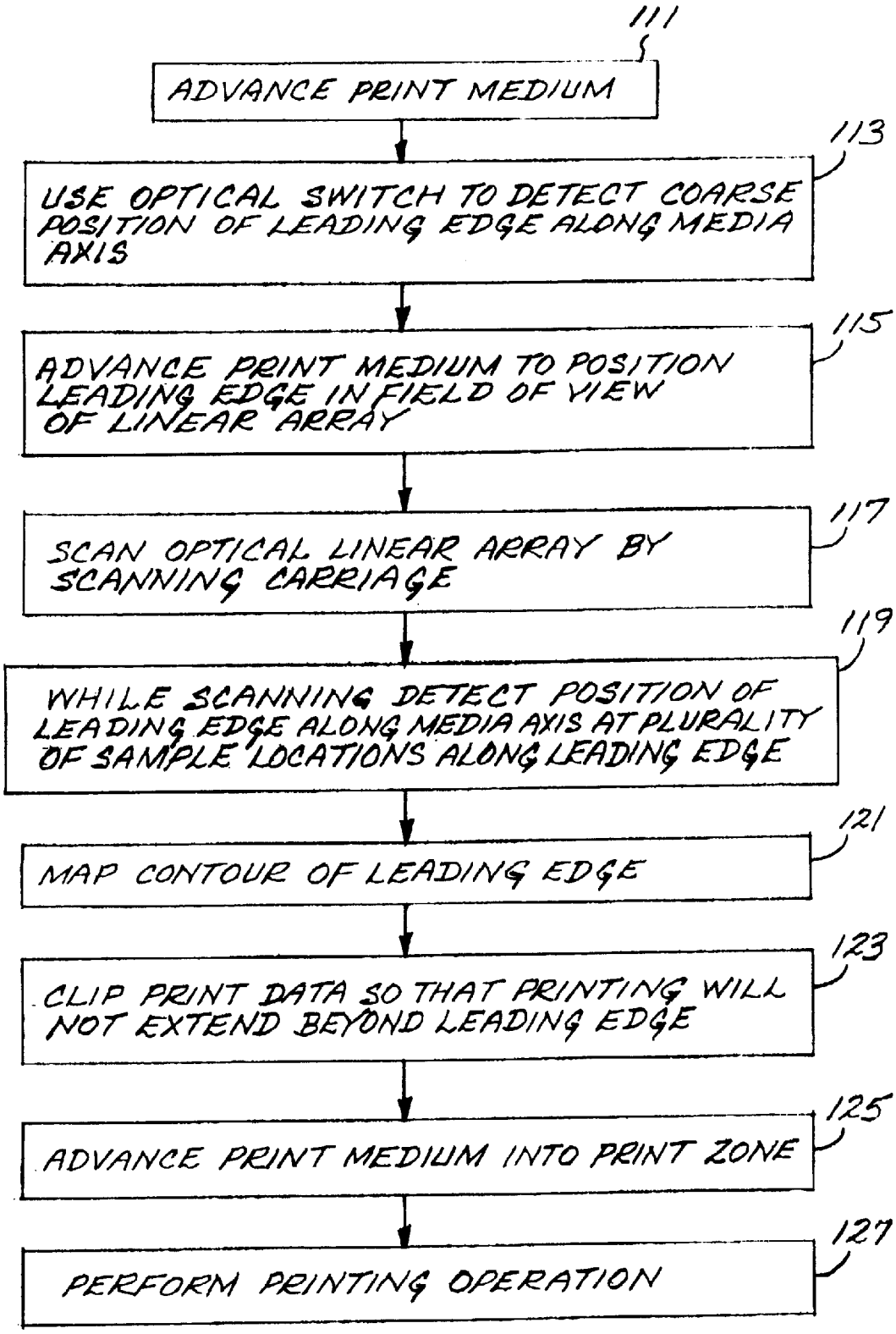
FIG. 7 is a flow diagram of a printing operation in accordance with one aspect of the invention.

Referring now to FIG. 7, set forth therein is a procedure for printing along the leading edge of the print medium 15. At 111 the print medium 15 is advanced in the media advance direction 27 so that the leading edge 15*a* thereof moves toward the media detect switch 53. At 113 a coarse position of the leading edge along the media axis is detected by the media detect switch 53, and at 115 the coarse position information is used to advance the print medium to stationarily position the leading edge in the field of view 55*a* of the linear array 55. At 117 the linear array 55 is scanned by scanning the print carriage 40, and at 119, while the carriage is being scanned, a fine position of the leading edge along the media axis is detected by the linear array 55 at a plurality of sample locations along the leading edge.

At 121 a contour of the leading edge 15*a* is mapped from the fine position samples, and at 123 the print data is appropriately clipped pursuant to the leading edge contour so that printing will not extend beyond the leading edge. At 125 the print media 15 is advanced into the print zone 25, and at 127 a printing operation is performed in accordance with the modified print data. The print data is clipped for example by turning off those pixels that are anticipated to be printed off the print medium, which can compensate for skew or a non-linear leading edge. Such clipping can be on a column by column basis or by groups of contiguous columns.

Further as to determining the fine position of the leading edge, a representative or average fine position can be determined, in which case entire pixel rows can be clipped.

Figure 8:
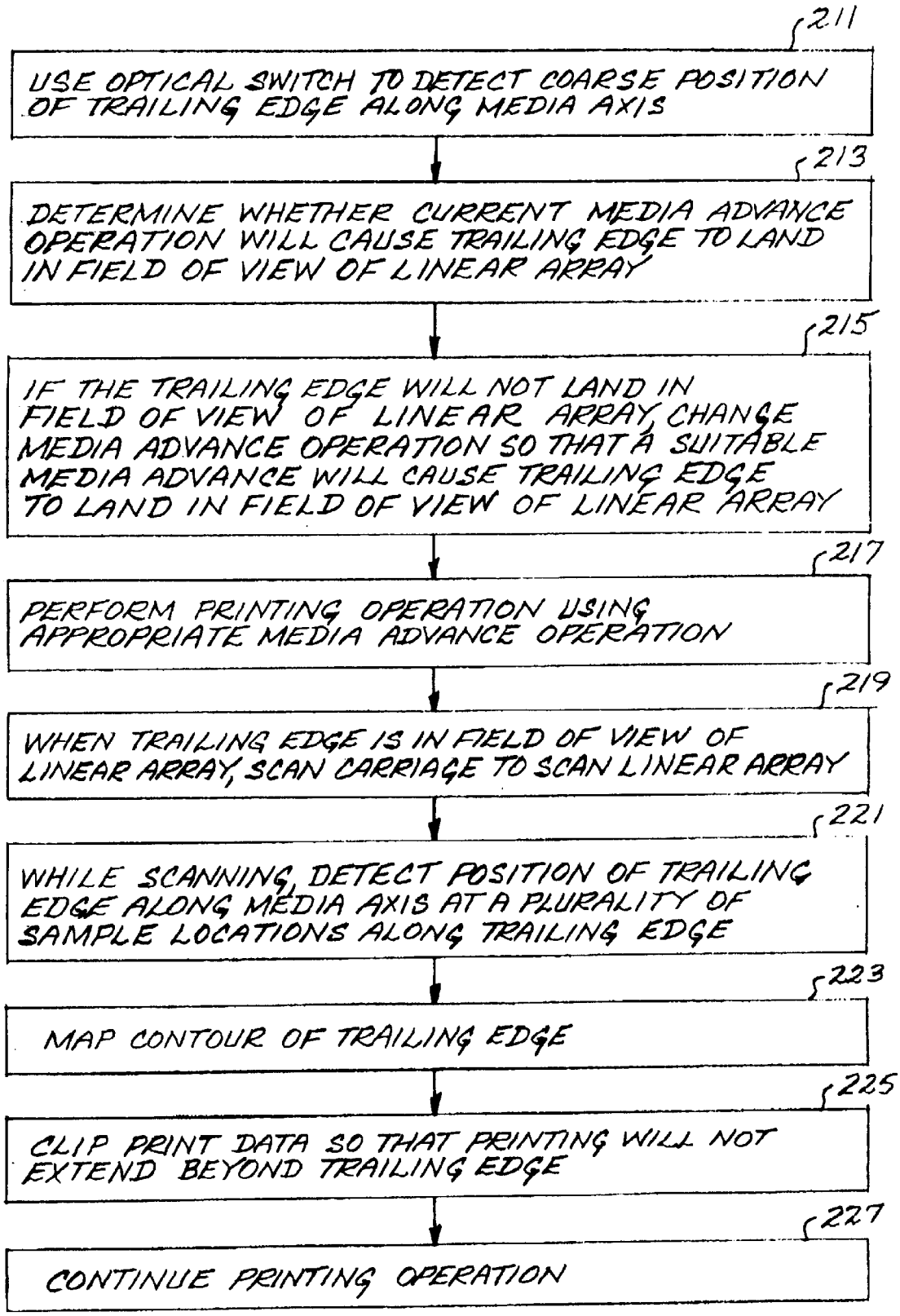
FIG. 8 is a flow diagram of a printing operation in accordance with another aspect of the invention.

Referring now to FIG. 8, set forth therein is a procedure for printing along the trailing edge of the print medium 15. At 211 a coarse position of the trailing edge 15*b* along the media axis is detected by the media detect switch 53, and at 213 a determination is made as to whether the nominal media advance of the current media advance operation will cause the trailing edge 15*b* of the print medium to land in the field of view 55*a* of the linear array 55, for example by determining the resting location along the media axis of the trailing edge at the end of the media advance that caused the media detect switch to be actuated and then determining whether an integral number of nominal media advances would position the trailing edge within the field of view 55*a*. At 215, if the trailing edge 15*b* will not land in the field of view 55*a* of the linear array 55, the media advance operation is changed to include a media advance or advances that will cause the trailing edge to land within the field of view of the linear array 55. At 217 printing continues using the appropriate media advance operation that will cause the trailing edge to land in the field of view 55*b* of the linear array 55.

At 219, when the trailing edge of the print medium 15 is positioned in the field of view, the linear array 55 is scanned by scanning the print carriage, and at 221, while scanning, a fine position of the trailing edge along the media axis is detected by the linear array 55 at different sample locations along the trailing edge. It should be appreciated that printing can also be performed during the steps of scanning and sampling. At 223 a trailing edge contour is mapped, and at 225 the print data is clipped in accordance with the trailing edge contour. At 227 printing continues using the clipped print data. The print data is clipped for example by turning off those pixels that are anticipated to be printed off the print medium, which can compensate for skew or a non-linear trailing edge. Such clipping can be on a column by column basis, or by groups of columns.

More particularly as to changing the media advance operation to insure that the trailing edge will land in the field of view of the linear array, this can be accomplished for example by modification of the current print mode or by changing to a different print mode to reduce the nominal media advance distance. The changed print mode or different print mode can provide for a reduced media advance distance by a variety of techniques including using fewer nozzles, and increasing the number of passes. Alternatively or additionally to changing print mode, at a suitable point in the media advance operation the print medium can be advanced by less than the nominal advance distance to position the trailing edge in the field of view of the linear array. The linear array is then scanned without printing, and trailing edge position samples are taken. After the optical scan, the media is advanced by the remaining distance of the nominal media advance, and printing can resume.

Further as to determining the fine position of the trailing edge, a representative or average fine position can be determined, in which case entire pixel rows can be clipped.

While the foregoing has been described in the context of a printer having a vacuum belt media advance system, it should be appreciated that the invention can be employed with other types of media advance systems including conventional pinch roller systems.

The foregoing has thus been a disclosure of printing techniques that advantageously provide for a leading and trailing edge position detection with a linear array optical detector having a field of view along the media axis that can be smaller than the media advance increments employed by the printer.

Although the foregoing has been a description and illustration of specific embodiments of the invention, various modifications and changes thereto can be made by persons skilled in the art without departing from the scope and spirit of the invention as defined by the following claims.

What is claimed is:

1. A printing apparatus comprising:

an array of ink jet printing nozzles;

a support structure for supporting said array of ink jet printing nozzles for reciprocating movement along a scan axis relative to a print medium such that said ink jet printing elements can print on a portion of the print medium that is in a print zone;

a media advance mechanism for advancing the print medium along a media advance axis through the print zone;

a coarse position detector for detecting an edge of the print medium that is generally transverse to the media advance axis;

a linear array optical detector for detecting said generally transverse edge; and a controller responsive to said coarse position detector and said linear array optical detector for advancing the print medium so that said transverse edge lands in the field of view of the linear array optical detector.

2. The printing apparatus of claim 1 wherein said linear array optical detector is located upstream of the print zone.

3. The printing apparatus of claim 2 wherein said coarse position detector comprises a media detect switch located upstream of said linear array optical detector.

4. The printing apparatus of claim 1 wherein said coarse position detector comprises an out of paper sensor.

5. The printing apparatus of claim 1 wherein said linear array optical detector is mounted on said support structure.

6. The printing apparatus of claim 1 wherein said linear array optical detector has a field of view along the media advance axis that is less than an incremental media advance employed by the printing apparatus.

7. The printing apparatus of claim 1 wherein said linear array optical detector has a field of view that overlaps said print zone along the media advance axis.

8. The printing apparatus of claim 1 wherein said linear array optical detector has a field of view contained within the print zone along the media advance axis.

9. The printing apparatus of claim 1 wherein said transverse edge comprises a leading edge.

10. The printing apparatus of claim 1 wherein said transverse edge comprises a trailing edge.

11. The printing apparatus of claim 1 wherein said controller further clips print data pursuant to position information provided by said linear array optical detector.

12. A method of printing, comprising the steps of:

advancing a sheet of print media towards a print zone;

detecting a coarse position of a leading edge of the print media with a coarse position sensor;

using the detected coarse position to advance the sheet of print media so as to position the leading edge of the print media in a field of view of an optical detector;

using the optical detector to detect the leading edge of the print medium and provide leading edge position information; and performing a printing operation using the leading edge position information to print on the print medium.

13. The method of claim 12 wherein the step of using the optical detector includes the step of optically scanning the leading edge.

14. The method of claim 13 wherein the step of optically scanning the leading edge includes the step of optically detecting the leading edge at a plurality of locations along the leading edge.

15. The method of claim 12 wherein the step of performing a printing operation includes the steps of:

modifying print data so that printing will not extend off the print medium beyond the leading edge; and printing on the print medium using the modified print data.

16. The method of claim 15 wherein the step of modifying print data includes the step of clipping print data.

17. A method of printing, comprising the steps of:

advancing a sheet of print medium through a print zone;

detecting a coarse position of a trailing edge of the print media with a coarse position sensor;

using the coarse position information to advance the print medium so as to position the trailing edge in the field of view of an optical detector;

using the optical detector to detect the trailing edge of the print medium to provide leading edge position information; and performing a printing operation using the trailing edge position information to print on the print medium.

18. The method of claim 17 wherein the step of using the coarse position information to advance the print medium includes the steps of:

determining whether a current media advance operation will cause the trailing edge to land in the field of view of the optical detector; and if the current media advance operation will not cause the trailing edge to land in the field of view of the optical position detector, modifying the current media advance operation so that the trailing edge will land in the field of view of the optical detector.

19. The method of claim 18 wherein the step of modifying the current media advance operation comprises the step of modifying a printing operation to cause the trailing edge to land in the field of view of the optical detector.

20. The method of claim 19 wherein the step of using the optical detector comprises the steps of optically scanning the trailing edge.

21. The method of claim 20 wherein the step of optically scanning the trailing edge includes the step of optically detecting the trailing edge at a plurality of locations along the trailing edge.

22. The method of claim 17 wherein the step of performing a printing operation includes the steps of:

modifying print data so that printing will not extend off the print medium beyond the trailing edge; and printing on the print medium using the modified print data.

23. A printing apparatus comprising:

an array of ink jet printing nozzles;

a support structure for supporting said array of ink jet printing nozzles for reciprocating movement along a scan axis relative to a print medium such that said ink jet printing elements can print on a portion of the print medium that is in a print zone;

a media advance mechanism for advancing the print medium along a media advance axis through the print zone;

a coarse position detector for detecting a coarse position along the media advance axis of an edge of the print medium that is generally transverse to the media advance axis;

a linear array optical detector for detecting a fine position along the media advance axis of said generally transverse edge, said linear optical detector including a field of view having an extent along the media advance axis;

a controller responsive to said coarse position detector and said linear array optical detector for advancing the print medium so that said transverse edge lands in the field of view of the linear array optical detector.

24. The printing apparatus of claim 23 wherein said linear array optical detector is aligned with the media axis.

25. The printing apparatus of claim 23 wherein said linear array optical detector is mounted on said support structure.

26. The printing apparatus of claim 23 wherein the extent of the field of view of said linear array optical detector along the media advance axis is less than an incremental media advance employed by the printing apparatus.

27. The printing apparatus of claim 23 wherein the field of view of said linear array optical detector overlaps said print zone along the media advance axis.

28. The printing apparatus of claim 23 wherein the field of view said linear array optical detector is contained within the print zone along the media advance axis.

29. The printing apparatus of claim 23 wherein said linear array optical detector is located upstream of the print zone.

30. The printing apparatus of claim 23 wherein said coarse position detector comprises a media detect switch located upstream of said linear array optical detector.

31. The printing apparatus of claim 23 wherein said coarse position detector comprises an out of paper sensor located upstream of said linear array optical detector.

32. The printing apparatus of claim 23 wherein said transverse edge comprises a leading edge.

33. The printing apparatus of claim 23 wherein said transverse edge comprises a trailing edge.

34. The printing apparatus of claim 23 wherein said controller further clips print data pursuant to position information provided by said linear array optical detector.

* * * * *